US007412867B2

(12) United States Patent
Boulin

(10) Patent No.: US 7,412,867 B2
(45) Date of Patent: Aug. 19, 2008

(54) TOOL FOR WORKING ON TUBES

(75) Inventor: Yves-Sébastien Boulin, Reims (FR)

(73) Assignee: Virax, Epernay (FR)

( * ) Notice: Subject to any disclaimer, the term of this patent is extended or adjusted under 35 U.S.C. 154(b) by 0 days.

(21) Appl. No.: 11/528,241

(22) Filed: Sep. 28, 2006

(65) Prior Publication Data

US 2007/0074559 A1 Apr. 5, 2007

(30) Foreign Application Priority Data

Sep. 30, 2005 (FR) ..... 05 10037

(51) Int. Cl.
*B21D 9/05* (2006.01)
*B21D 31/00* (2006.01)

(52) U.S. Cl. ..... 72/389.9; 72/390.2

(58) Field of Classification Search ..... 72/389.1, 72/389.2, 389.9, 390.2, 390.4, 390.5
See application file for complete search history.

(56) References Cited

U.S. PATENT DOCUMENTS 4,989,441 A 2/1991 Wagner
5,761,950 A * 6/1998 Chiu ..... 72/390.5
6,931,908 B1 * 8/2005 Mitson ..... 72/390.2
7,219,574 B2 * 5/2007 Ichida et al. ..... 74/502.2

FOREIGN PATENT DOCUMENTS

| | | |
|---|---|---|
| DE | 23 03 475 | 8/1974 |
| DE | 39 25 950 | 2/1991 |
| EP | 0 041 432 | 12/1981 |
| FR | 1 048 435 | 12/1953 |
| FR | 2 626 505 | 8/1989 |

* cited by examiner

*Primary Examiner*—Derris H. Banks
*Assistant Examiner*—Teresa Bonk
(74) *Attorney, Agent, or Firm*—Wenderoth, Lind & Ponack, L.L.P.

(57) ABSTRACT

The present invention relates to the tool for working tubes. The tool includes a body having hinged thereto a trigger for moving back-and-fourth, and which is connected to a support member supporting a working head. A drive device is provided for driving the support member mounted on the body and connected to the trigger. The support member includes a toothed rack, and the drive device includes a first toothed gearwheel having a first module and meshing with the rack, a drive pawl serving to advance the rack forwards, and a retaining pawl preventing it from moving backwards. The drive device includes a second toothed gearwheel having a second module smaller than the first module, the second gear-wheel being secured to the first gearwheel, the drive pawl and the retaining pawl being engaged with the second gearwheel.

12 Claims, 11 Drawing Sheets

TOOL FOR WORKING ON TUBES

The invention relates to a tool for working on tubes, the tool being a type comprising a body having hinged thereon an actuator trigger for moving back-and-fourth, and the tool being movably connected to a support member supporting a working head. A drive device is provided for driving the support member mounted on the body and is connected to the actuator trigger. The support member comprises a rack with large teeth, the drive device comprising a first gearwheel with large teeth meshing with the rack, a drive pawl, and a retaining pawl, the drive pawl serving to cause the rack to advance in the desired direction. The retaining pawl prevents the rack from reversing in the direction opposite to the desired direction, thus enabling the rack to move forwards progressively under a drive from back-and-fourth drive movement of the actuator trigger.

BACKGROUND OF THE INVENTION

In the field of working on tubes, it is known to use bending tools, shears for cutting, flaring flyers, or tools for press fitting rings on the ends of a tube.

Progress in tube applications towards using multi-layer materials of the polyethylene-aluminum-polyethylene type, and towards using ever increasing tube diameters, up to 32 millimeters (mm), has caused manufacturers of apparatuses for working on tubes to develop devices that require ever increasing amounts of force to be applied to the working head. Thus, when it is desired to bend polyethylene-aluminum-polyethylene multi-layer tubes, this operation requires a high level of force (500 decanewtons (daN) to 600 daN) to be applied to the head working on the tube.

Nevertheless, using a conventional manual apparatus does not enable work to be carried out on large-diameter tubes made of the rigid multi-layer materials. The force passing via a lever arm is transformed into a force acting on the tube by engaging a transmission member, such as a tooth. The return angle through which the lever arm moves between two actuations is thus a function of the dimensioning of the engaged transmission member, and that is difficult to make compatible with the desired mechanical strength. Furthermore, the length of the lever arm is limited by the ergonomics of working with one hand only.

OBJECTS AND SUMMARY OF THE INVENTION

In one aspect, the invention provides a tube-working tool that is ergonomic, while enabling high forces to be developed on the working head.

To this end, the invention provides a tool of the above-specified type. The driver device further comprises a second gearwheel having small teeth and secured to the first gearwheel, while the drive and retaining pawls are engaged with the second gearwheel.

According to other characteristics, the first and second gearwheels form a stepped gear-wheel made as a single piece. The rack is mounted to slide relative to the body, and the rack is a toothed sector mounted pivotably relative to the body. The drive pawl and the retaining pawl have mutually engaging contact surfaces suitable for disengaging the retaining pawl from the second gearwheel under the action of an unlocking movement of the trigger, thus enabling the rack to move in reverse (i.e., in a direction opposite a working direction). The drive pawl comes into contact with a cam of the retaining pawl, compresses its bias spring, comes into rear abutment, and then disengages the retaining pawl by compressing the bias spring thereof. The drive pawl and the retaining pawl are identical. The tool includes a working head for bending tubes, and the tool includes a working head in the form of a die and two side abutments for supporting a tube during the bending process, and mounted at each end of a supporting crossbar provided on the body.

In another aspect, the invention seeks to reduce the force required to unlock the retaining pawl when used with multi-layer tubes, which are very elastic. This problem is solved by the fact that in a tool for working on tubes of the above-specified type, the drive and retaining pawls have mutually-engaging contact surfaces suitable for disengaging the retaining pawl from the second gearwheel under derive from an unlocking movement of the trigger, thus enabling the rack to move rearwards. More particularly, for unlocking purposes, when the trigger performs an unlocking movement, a mechanism is provided in which the drive pawl comes into contact with a cam of the retaining pawl, compresses its bias spring, comes into rear abutment (i.e., abuts a surface of the actuator trigger), and then disengages the retaining pawl by compressing the bias spring thereof.

BRIEF DESCRIPTION OF THE DRAWINGS

The invention is described below in non-limiting manner in the context of an application to manually bending tubes and with reference to the accompanying figures, in which.

DETAILED DESCRIPTION OF THE INVENTION

Figure 1:
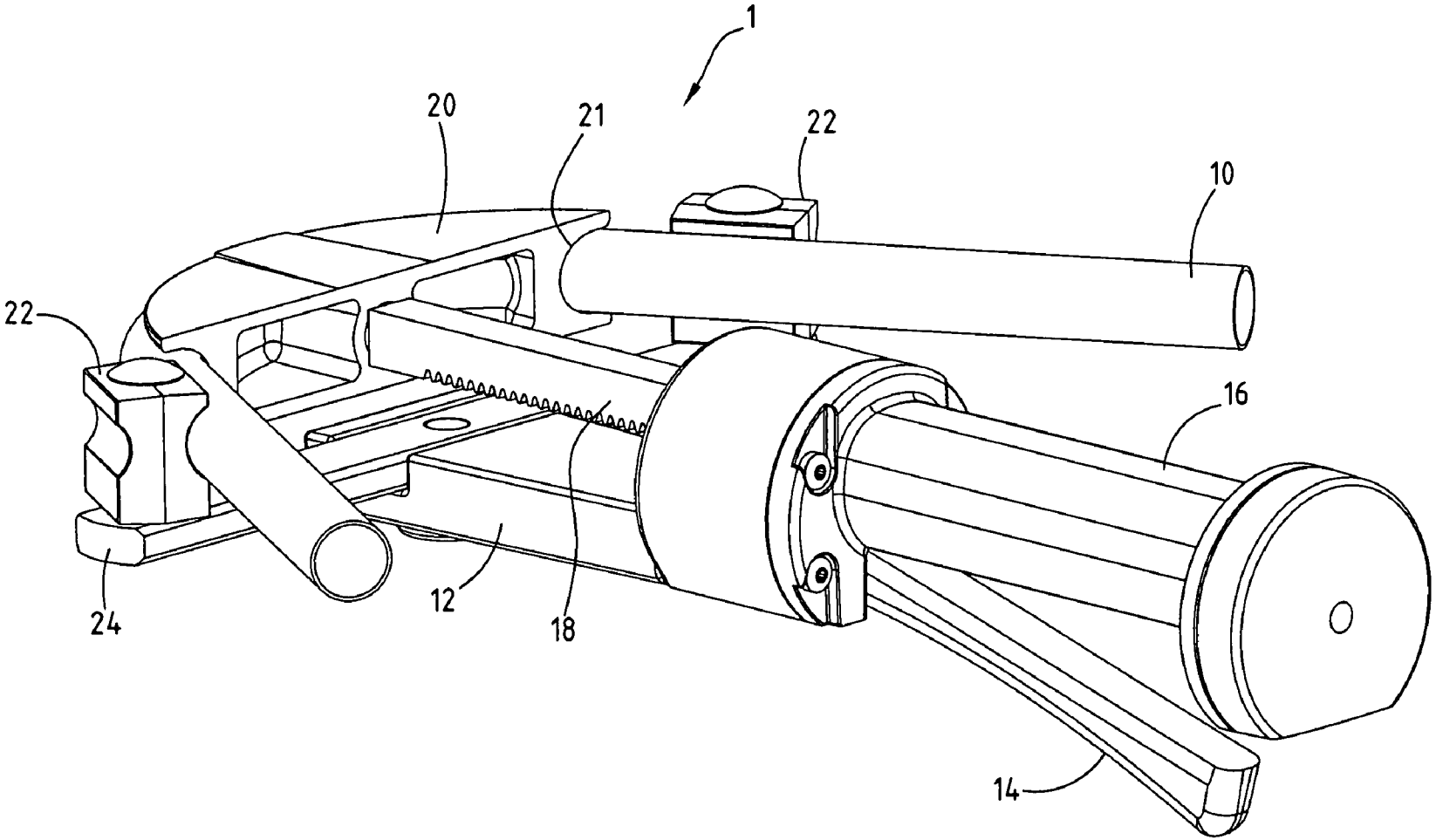
FIG. 1 is a perspective view of a tool of the invention.

The tool of FIG. 1 is a manual bender 1 for a bending tube 10, and assumed for convenience of description to have its rear portion to the right, as shown. The bender 1 is of the crossbow type, and comprises a body 12 having an actuator trigger 14 hinged thereto, and having a handle 16 connected thereto by fastener means. A support member 18 securely supporting a working head 20 is movably connected to the body 12. The working head 20 is in the form of a semi-cylindrical die including a groove 21 suitable for receiving the tube 10 for bending to a particular desired radius. Two side stops 22 for supporting the tube 10 during the bending process are mounted at opposite ends of a crossbar 24 provided on the body 12.

Figure 2:
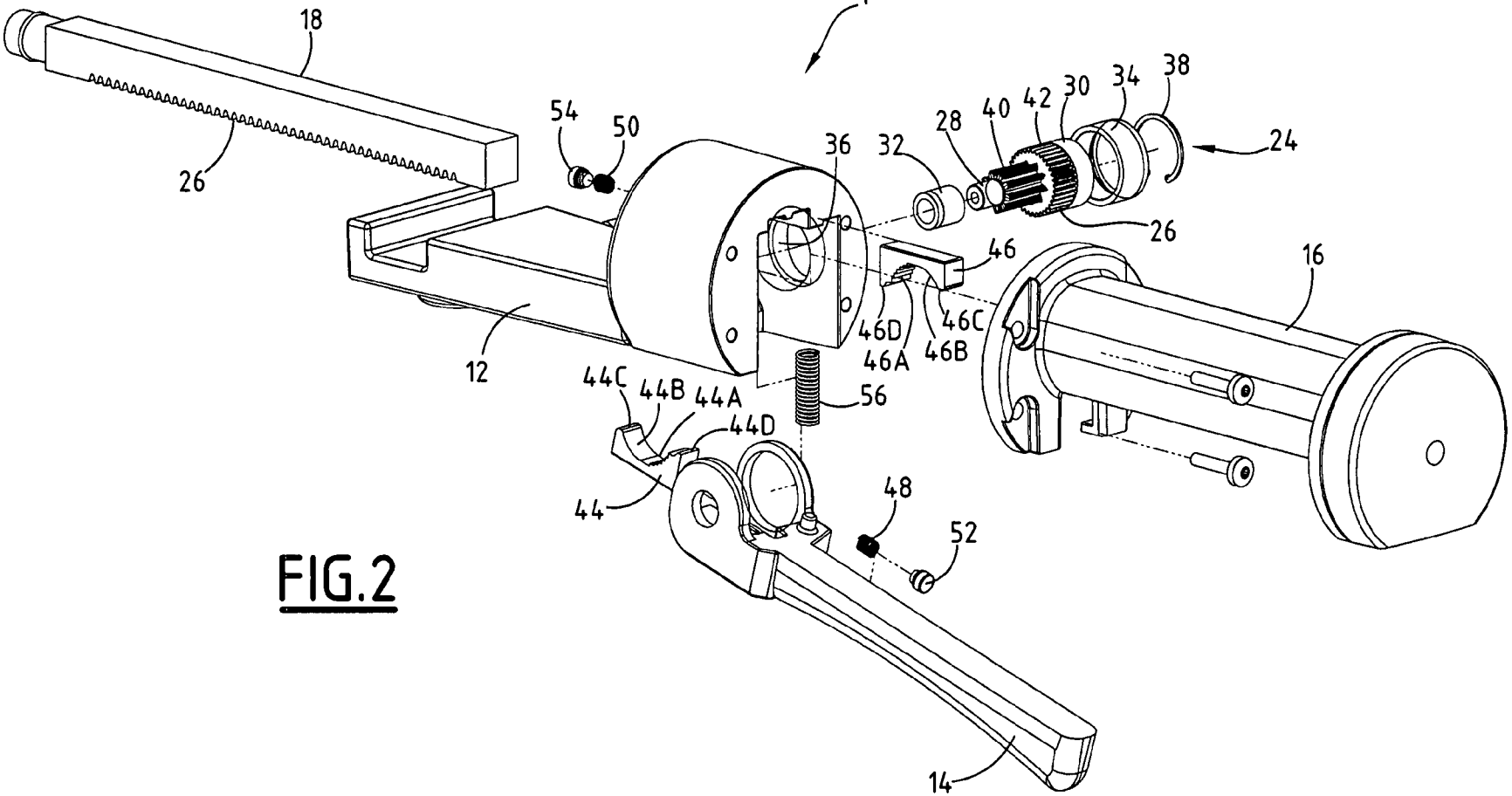
FIG. 2 is an exploded perspective view of the FIG. 1 tool.

With reference to FIG. 2, a driver device 24 of the support member 18 is hinged on the body 12 and is connected to the actuator trigger 14. The support member 18 comprises a linear rack 26 having large teeth on its bottom face. The driver device 24 comprises a transverse shaft 26 that turns in the body 12 and that has ends forming bearing surfaces 28 and 30. Bearings 32 and 34 are respectively mounted on the bearing surfaces 28 and 30. In its intermediate portion, the shaft 26 includes a first gearwheel 40 having large teeth meshing with the rack 26, and a second gearwheel 42 having small teeth and secured to the first gearwheel 40. As shown in, for example, 3A-4F, each of the first gearwheel 40 and the second gearwheel 42 has teeth of a uniform site and spaced evenly around the entire periphery of the gearwheel.

In the example shown, the first and second gear-wheels 40 and 42 form a stepped or "cluster" gearwheel made integrally by molding and rectified by machining. The number of teeth on the first gearwheel 40 is nine; the number of teeth on the second gearwheel 42 is thirty-five. The module of the first gearwheel 40 is 1.25, while the module of the second gearwheel 42 is 0.6.

Once assembled, the shaft 26 is mounted to turn in the body 12 via bores 36 formed in the body 12, and it is held therein by a spring clip 38.

The driver device 24 further comprises a drive pawl 44 and a retaining pawl 46, both pawls 44 and 46 presenting small teeth suitable for engaging with the teeth of the second gearwheel 42. The drive and retaining pawls 44 and 46 are identical and generally in the form of rectangular blocks. Each has a rectangular face that is profiled so as to form four zones. Each of the drive and retaining pawls 44 and 46 includes a respective toothed zone 44A, 46A, a smooth and concave disengagement zone 44B, 46B, and two cam zones 44C, 46C and 44D, 46D situated at the opposite ends of the profiled face.

The drive pawl 44 and the retaining pawl 46 are mounted diametrically opposite each other and slidably respectively in the handle 14 and in the body 12. The drive pawl 44 serves to cause the rack 26 to advance in the desired (working) direction, while the retaining pawl prevents the rack 26 from reversing in the direction opposite to the desired (working) direction. Springs 48 and 50, bearing respectively against abutments 52 and 54 of the trigger 14 and of the body 12 bias the drive pawl 44 and the retaining pawl 46 respectively towards their positions of engagement with the second gearwheel 42.

A helical compression spring 56 having its first end connected to the body 12 and second end connected to the trigger 14 biases the trigger towards a position where it is spaced apart from the handle 16. The trigger 14 is hinged to pivot on the body 12 between the position spaced apart from the handle 16 and a position close to the handle 16. The back-and-fourth movement of the actuator trigger 14 between the spaced-apart position and the position close to the handle 16 against the force from the compression spring 56 produces stepwise forward advance movement of the rack 26 (i.e., movement in the working direction).

In the example of the crossbow bender, the rack 26 is mounted to slide relative to the body 12. In other applications, the rack can be a toothed sector mounted to pivot relative to the body 12.

The operation of the forward movement of the rack 26 is described below with reference to FIGS. 3A to 3C.

Figure 3A:
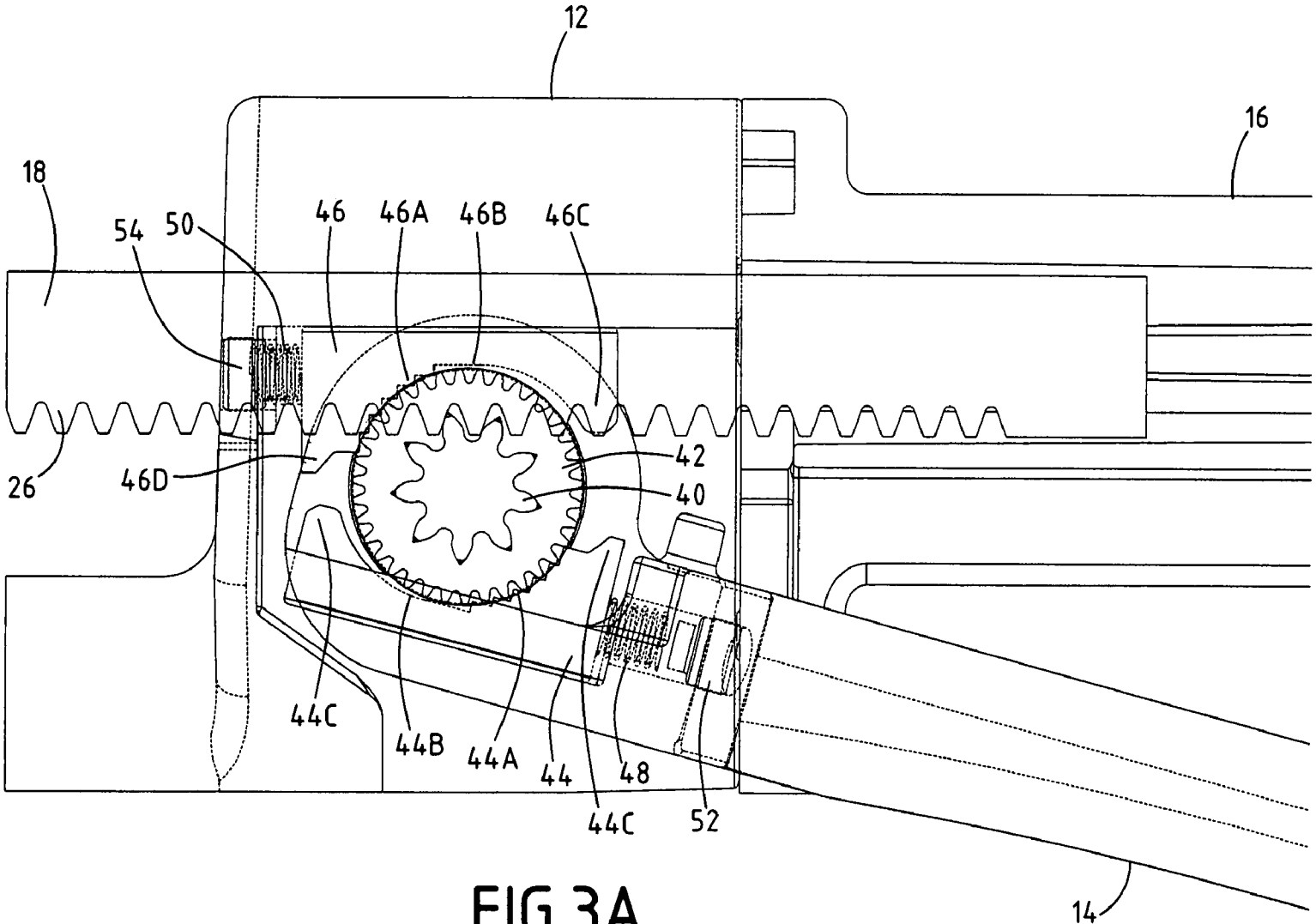
FIGS. 3A to 3C show the steps of driving the FIG. 1 tool.
Figure 3B:
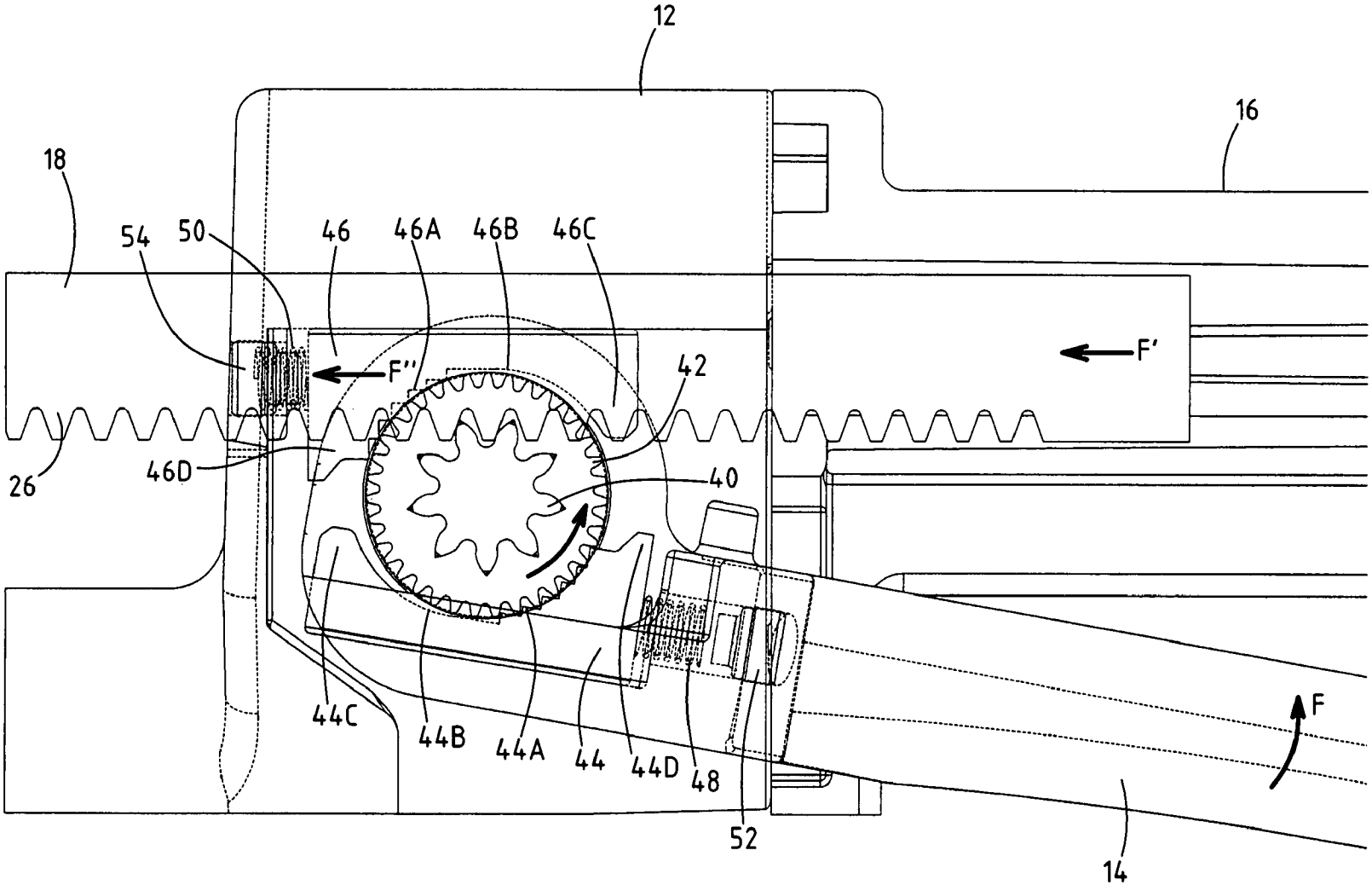

In FIG. 3A, the trigger 14 is in a position spaced apart from the body 16 by an angle of about 15°. The zones 44A and 46A having small teeth respectively on the drive pawl 44 and on the retaining pawl 46 are engaged with the teeth of the second gearwheel 42, while the smooth zones 44B and 46B respectively of the pawls 44 and 46 do not interfere with the second gearwheel 42. A force exerted on the trigger 14 in the direction of arrow F in FIG. 3B urges the trigger 14 towards the handle 16. In the resulting counter-clockwise rotary movement, the drive pawl 44 remains engaged with the second gear-wheel 42 and thus drives the first gearwheel 40 in the counter-clockwise direction, thereby causing the rack 26 to advance in the direction of arrow F' of FIG. 3B. Simultaneously, under the action of the counter-clockwise rotation of the second gearwheel 42, the toothed zone 46A of the retaining pawl 46 slides over the teeth of the second gearwheel 42 and reverses in the direction of arrow F" in FIG. 3B, with this reversing action taking place against the spring 50.

Figure 3C:
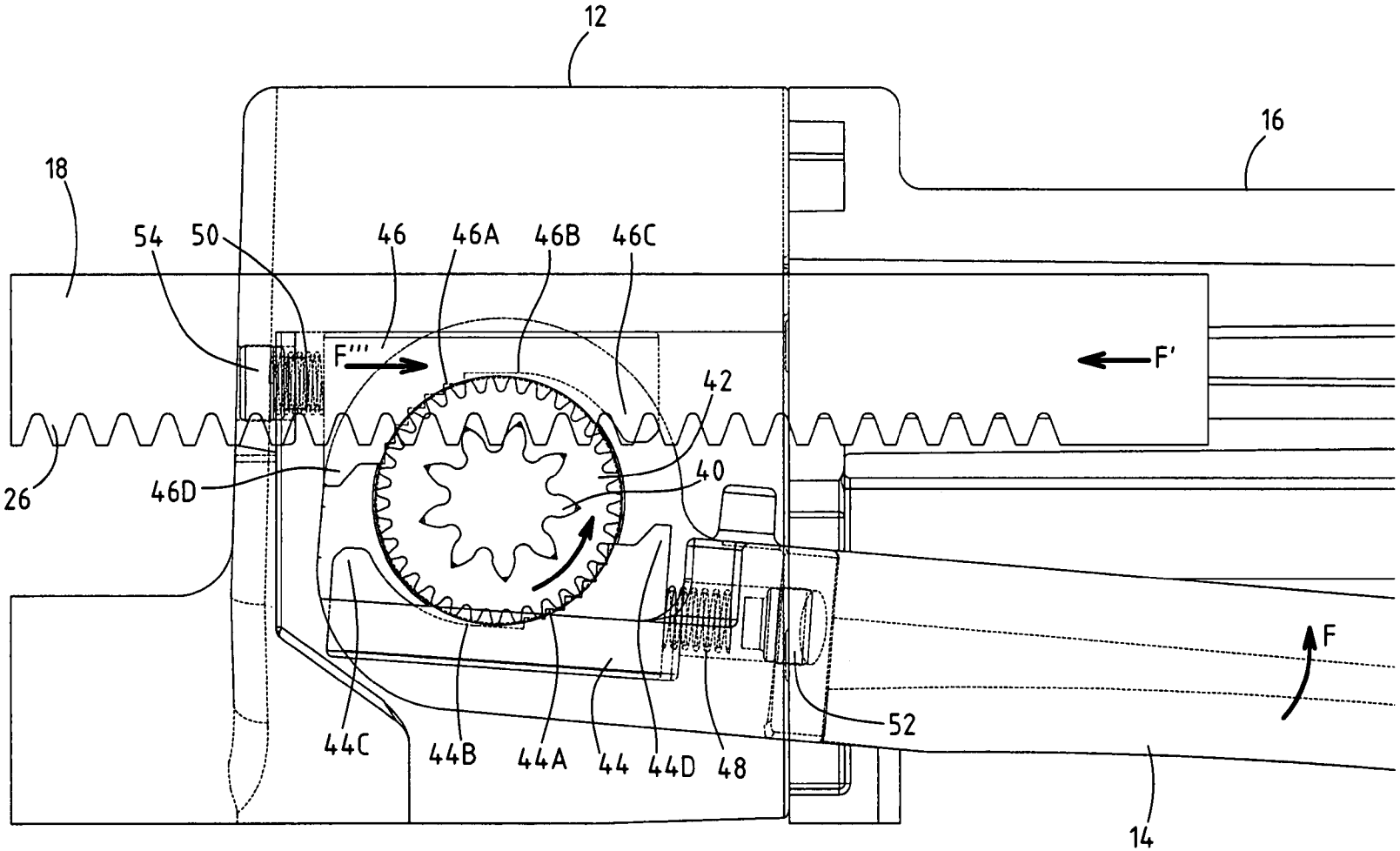

As shown in FIG. 3C, by continuing to apply force urging the trigger 14 towards the handle 16, as represented by arrow F, the toothed zone 44A of the drive pawl 44 remains engaged with the teeth of the second gearwheel 42, and the first gearwheel 40, which is secured to the second gearwheel 42, continues to turn, thereby causing the rack 26 to advance progressively in the direction of arrow F' in FIG. 3C (i.e., the working direction). Simultaneously, since the reversal of the retaining pawl 46 allows the teeth of the second gear-wheel 42 to pass, the toothed zone 46A of the retaining pawl 46 again engages the teeth of the second gearwheel 42 under the effect of bias from the spring 50 in the direction of arrow F'" in FIG. 3C. Under the action of the compression spring 56 urging the trigger 14 towards its position spaced apart from handle 16 (the spring 56 being omitted from the FIGS. 3A to 3C for reasons of clarity in the drawings), the toothed zone 46A of the retaining pawl 46 remains engaged with the teeth of the second gearwheel 42, preventing the second gearwheel 42, and thus also the first gearwheel 40, from turning in the clockwise direction. This blocking action holds the rack 26 in the previously-reached advanced position, in spite of it being urged backwards by the resistance to bending of the tube that is being bent. Still under the action of the compression spring 56, and simultaneously, the toothed zone 44A of the drive pawl 44 slides over the teeth of the second gearwheel 42, thereby allowing the drive pawl 44 to move back against the spring 48, the release of the drive pawl 44 allowing the trigger 14 to return clockwise towards its initial position shown in FIG. 3A. The return angle thus obtained is about 15°.

A succession of back-and-forth movements of the trigger 14 tending to move the trigger 14 towards and then away from the handle 16 thus enables the rack 26 to advance progressively forwards. By means of the first and second gearwheels being mounted in a stepped configuration and secured to each other, the inward movement of the trigger 14 is decoupled from the advance movement of the rack 26. This makes it possible to obtain both high levels of thrust force on the working head, because of the large teeth of the rack and of the gearwheel 40, and a return angle that is moderate and ergonomic, because of the small teeth of the gearwheel 42.

In another aspect of the invention, there follows a description of the retaining pawl 46 being unlocked, enabling the rack 26 to reverse. This description is given with reference to FIGS. 4A to 4E.

Figure 4A:
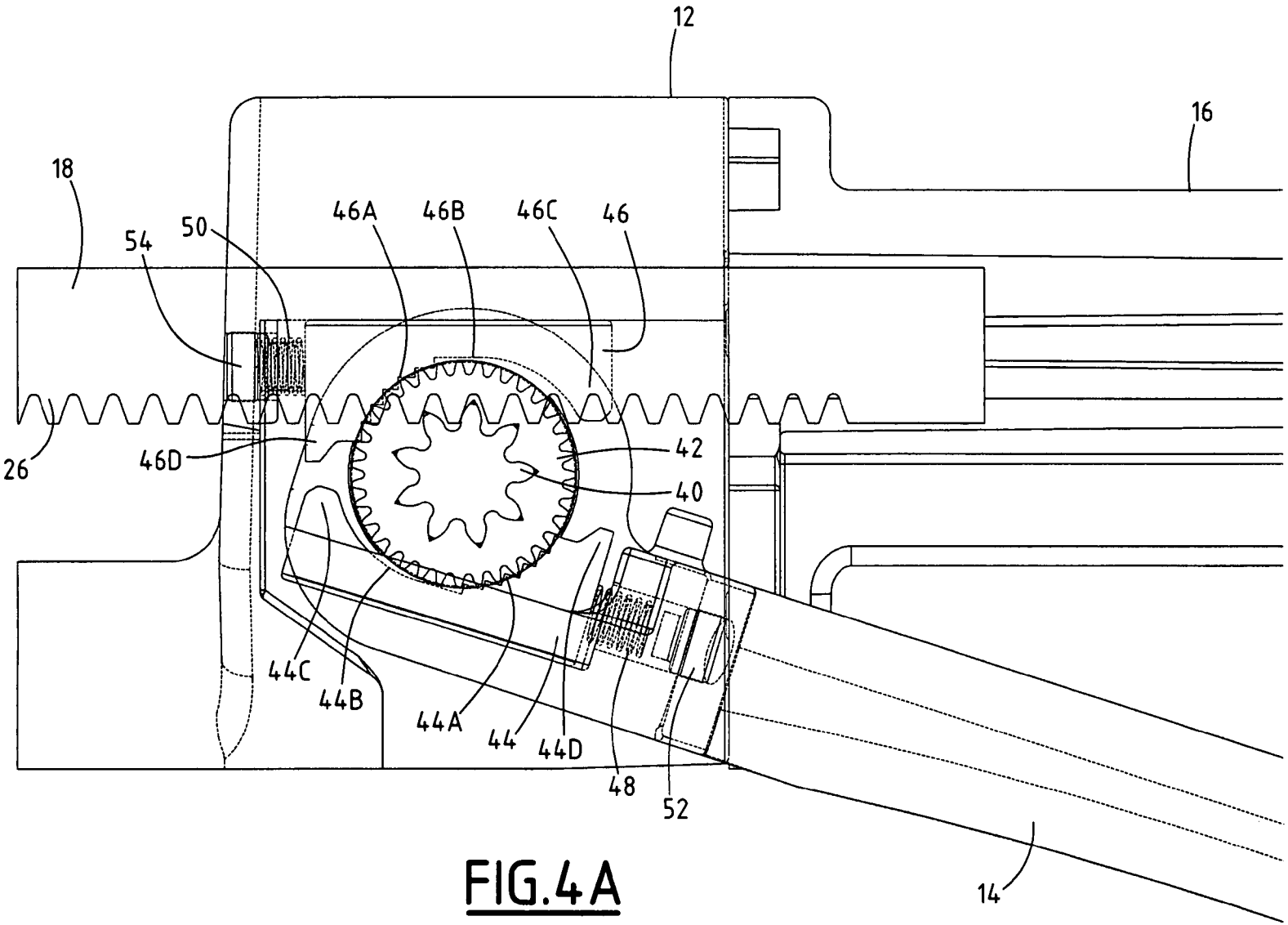
FIGS. 4A to 4F show the steps of unlocking the retaining pawl of the FIG. 1 tool.
Figure 4B:
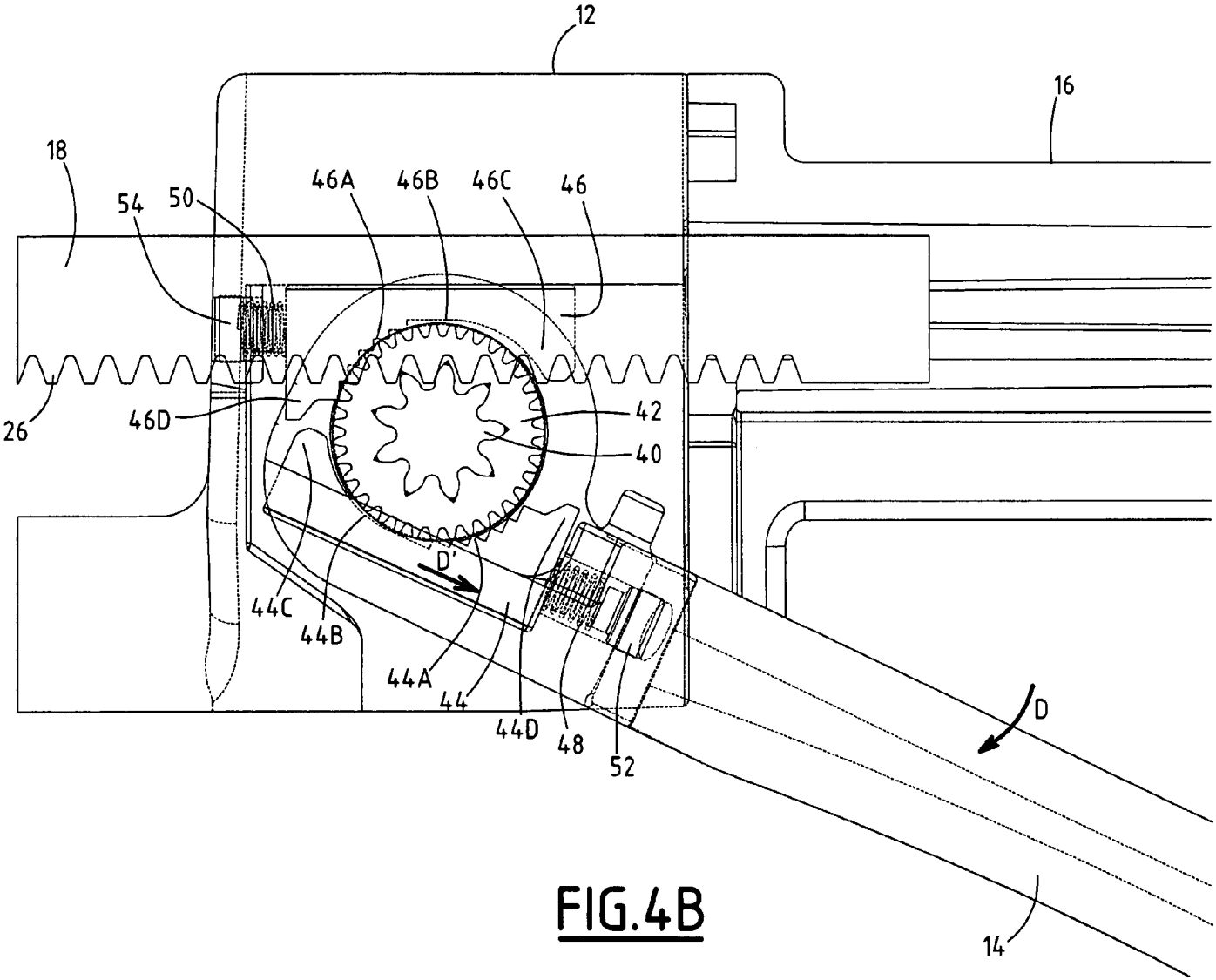

In FIG. 4A, the actuator trigger 14 is in its position spaced apart from the handle 16 by about 15°. The respective toothed zones 44A and 46A of the drive and retaining pawls 44 and 46 are engaged with the teeth of the second gearwheel 42 under bias from the respective springs 48 and 50. Since the stepped first and second gearwheels 40 and 42 are held stationary by the action of the retaining pawl 46, the rack 26 remains stationary in the advanced position. Under the action of a force tending to move the trigger 14 clockwise away from the handle 16 along arrow D in FIG. 4B, the toothed zone 44A of the drive pawl 44 slides over the teeth of the second gearwheel 42, with reverse movement of the drive pawl 44 taking place in sliding relative to the trigger 14 against the spring 48 in the direction of arrow D' of FIG. 4B.

Figure 4C:
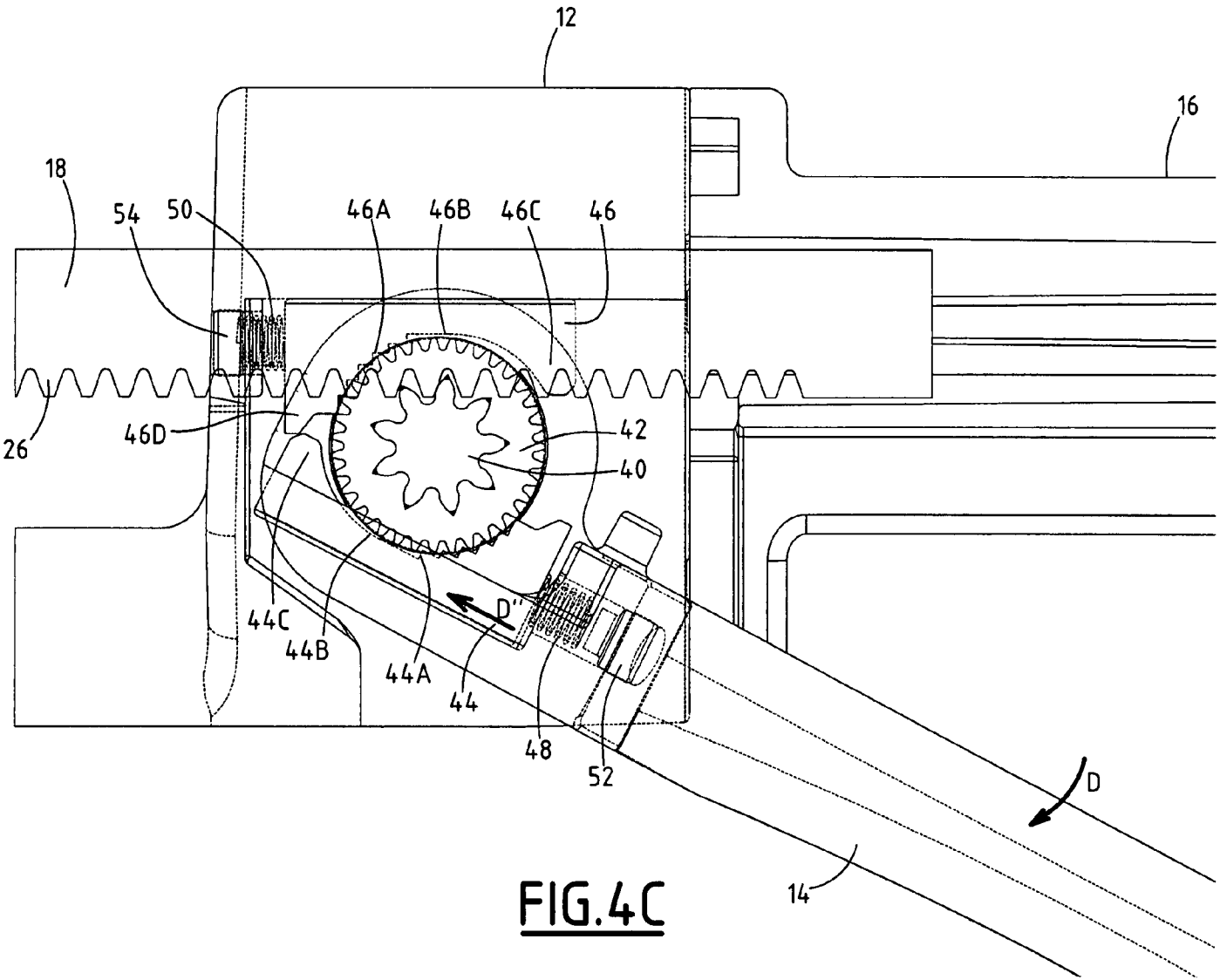
Figure 4D:
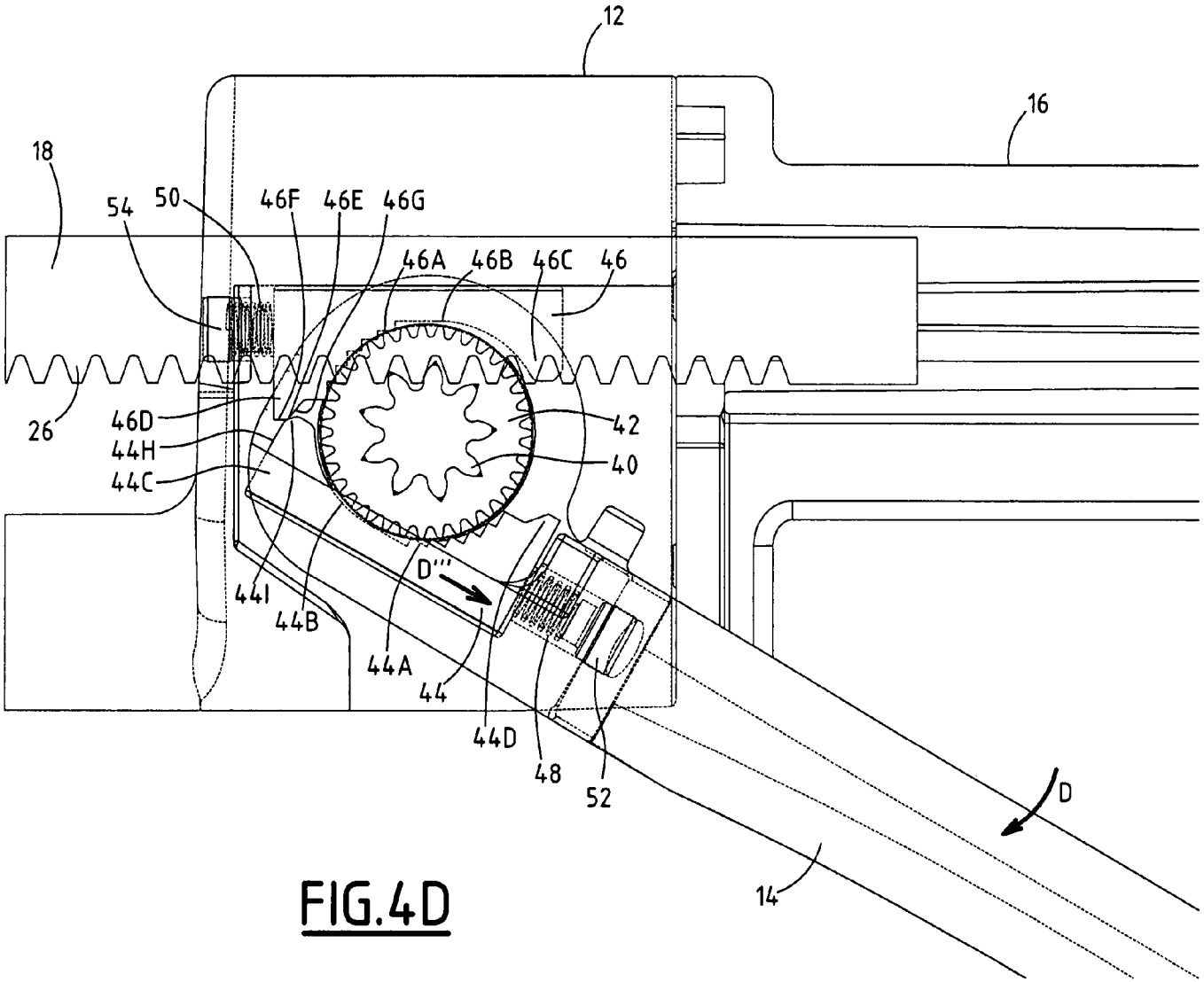

By continuing the movement of the trigger 14 away from the handle 16 along arrow D in FIG. 4C, once the drive pawl 44 has reversed sufficiently against the spring 48, the toothed zone 44A of the drive pawl 44 passes over the tips of the teeth of the second gearwheel 42. Under urging from the spring 48, the drive pawl 44 slides forward along arrow D" in FIG. 4C. In this position, the cam zone 44C of the drive pawl 44 is in register with the cam zone 46D adjacent to the toothed zone 46A of the retaining pawl 46 and opposite the cam zone 46C of the same retaining pawl 46.

Still continuing to move the actuator trigger 14 away from the handle 16 (FIG. 4D), a ramp 44I of the cam zone 44C of the drive pawl 44, which ramp is adjacent to an end face 44H, comes into contact with an edge 46E defined by the intersection of two sliding surfaces 46F and 46G of the cam zone 46D of the retaining pawl 46. Under the effect of the trigger 14 turning clockwise, the drive pawl 44 reverses as represented by arrow D''' in FIG. 4D against the spring 48. Since the cam zone 44C of the drive pawl 44 is in abutment against the cam zone 46D of the retaining pawl 46, the toothed zone 44A of the drive pawl 44 disengages from the teeth of the second gearwheel 42 by compressing the spring 48.

By continuing to move the trigger 14 away from the handle 16 so as to reach an angular position of about 30° relative to the handle 16 (FIG. 4E), the end face 44H of the drive pawl 44 comes into contact with the sliding surface 46G of the retaining pawl 46. The end face 44H of the drive pawl 44 and the sliding surface 46G of the retaining pawl 46 are arranged in such a manner that turning the trigger 14 clockwise, as represented by arrow D in FIG. 4E, reverses the drive pawl 44 and brings it into abutment against the trigger 14, as represented by arrow D'''' in FIG. 4E. As a result, the toothed zone 44A of the drive pawl 44 becomes totally disengaged from the teeth of the second gearwheel 42.

Figure 4E:
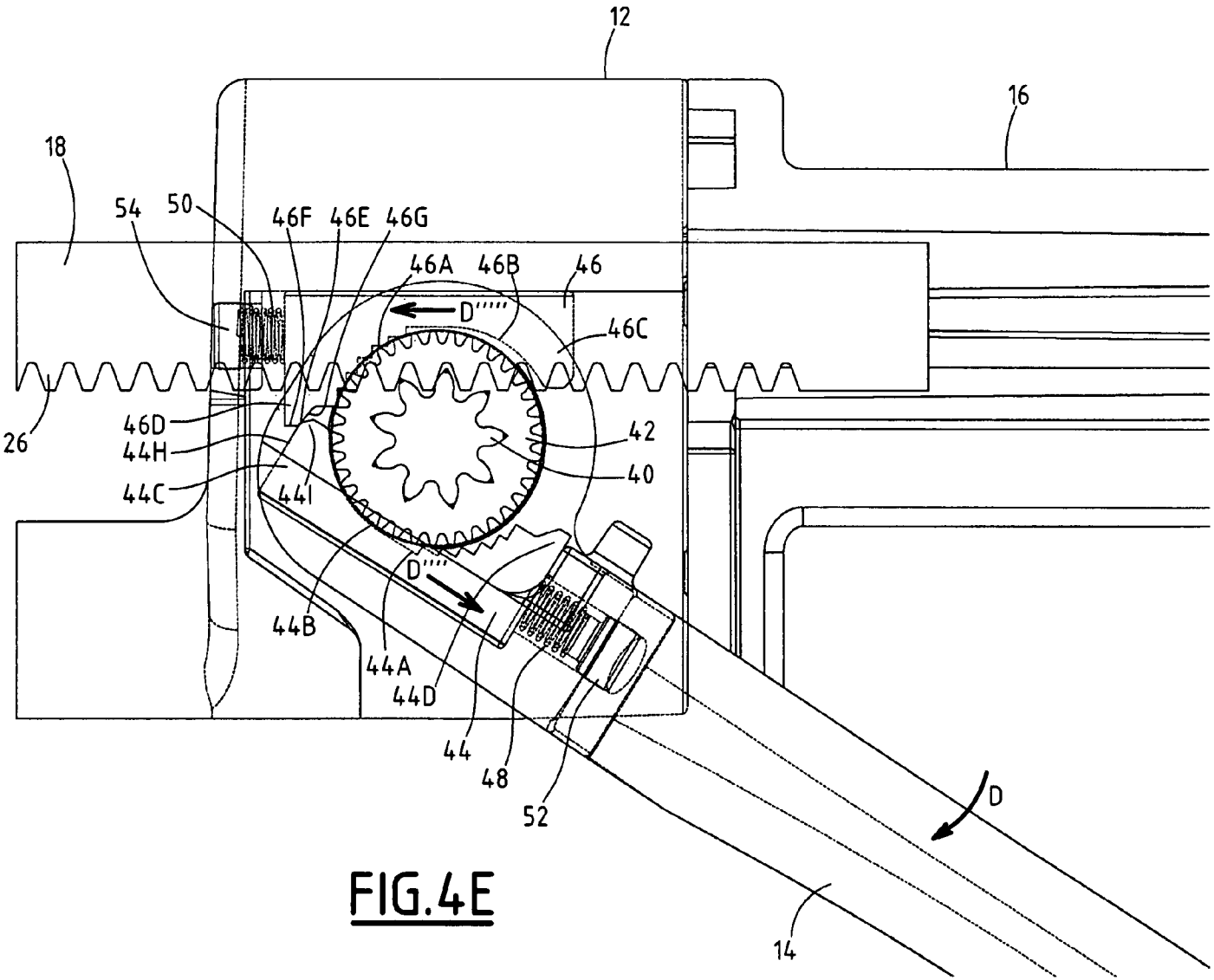

Simultaneously, under the action of the clockwise turning movement of the trigger 14, the contact between the edge 46E of the retaining pawl 46 and the end face 44H of the drive pawl 44 gives rise to reverse movement of the retaining pawl 46 against the spring 50 along arrow D''''' of FIG. 4E, with the reverse movement tending to disengage the toothed portion 46B of the retaining pawl 46 from the teeth of the second gearwheel 42. Continuing the clockwise turning of the trigger 14 away from the handle 16 beyond 30° (FIG. 4F), disengages the toothed zone 46B of the retaining pawl 46 completely from the teeth of the second gearwheel 42.

Figure 4F:
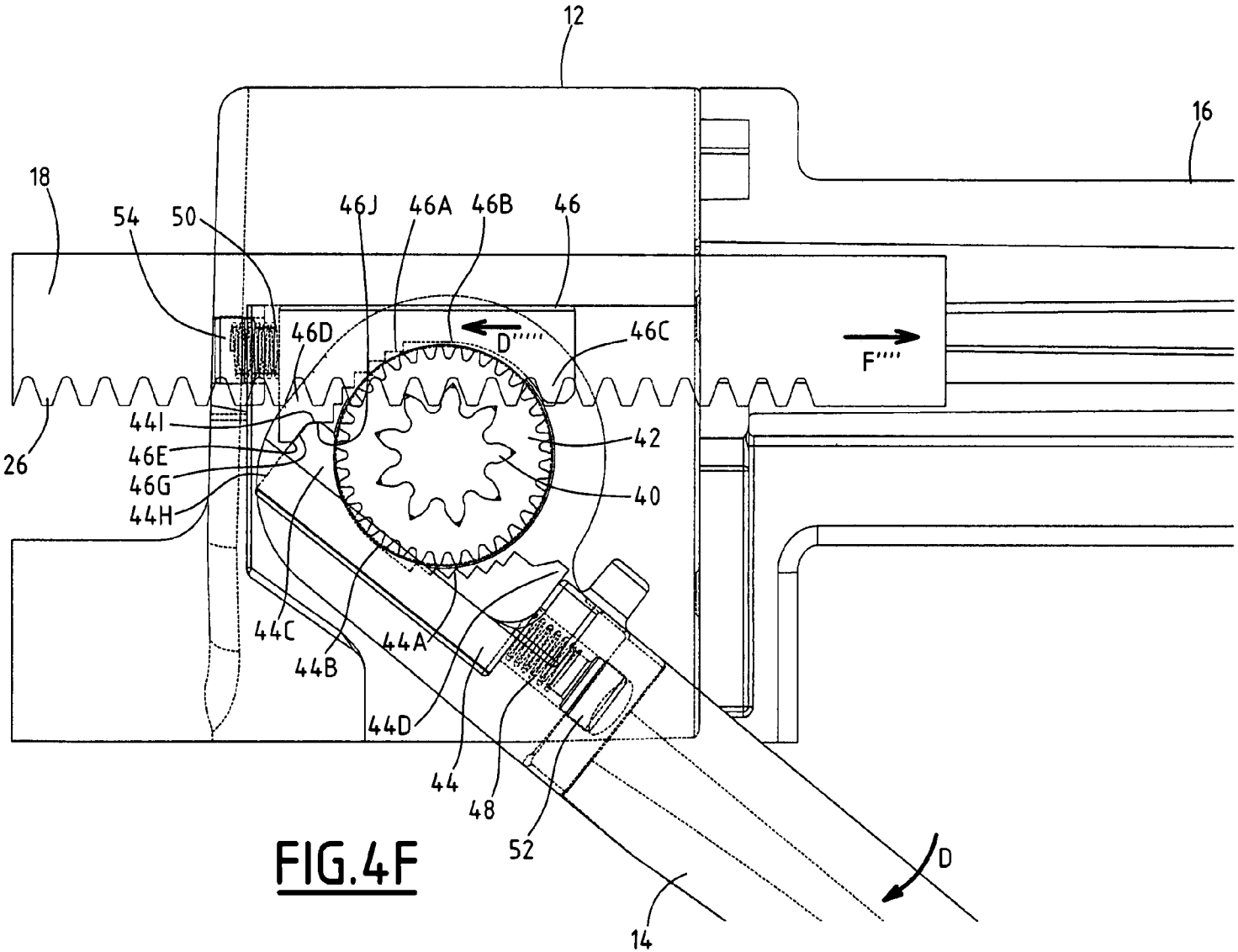

The contact of the end face 44H of the drive pawl 44 with the edge 46E and with the sliding surface 46G of the retaining pawl 46, followed by the ramp 44I of the drive pawl 44 coming into abutment against a surface 46J situated between the sliding surface 46G and the toothed zone 46A of the retaining pawl 46, accentuates the reverse movement of the retaining pawl 46 against the spring 50 along arrow D''''' of FIG. 4F. The toothed zone 46A of the retaining pawl 46 is then completely disengaged from the teeth of the second gearwheel 42. Since the first gear-wheel 40 and the second gearwheel 42 are united, and since the drive pawl 44 and the retaining wall 46 are disengaged from the teeth of the second gear-wheel 42, it then becomes possible to cause the rack 26 to move in reverse along arrow F'''' of FIG. 4F. Since movement in the counter-clockwise direction tends to move the trigger 14 towards the handle 16, the cam zone 44C of the drive pawl 44 is disengaged from the cam zone 46D of the retaining pawl 46, and the respective toothed zones 44A and 46A of the drive pawl 44 and of the retaining pawl 46 can be reengaged with the teeth of the second gearwheel 42. The tool is thus ready for another working cycle.

The invention as described above applies to bending tubes. However, it could be applied to an operation of cutting tubes, of putting end rings into place on tubes, or to expanding tube ends to form sockets.

What is claimed is:

1. A tube-working tool comprising:

a body;

an actuator trigger hinged to said body for pivoting relative to said body;

a support member supporting a working head, said support member comprising a toothed rack and being movably connected to said body; and a drive device mounted on said body and connected to said actuator trigger, said drive device being operable to move said support member relative to said body, said drive device including:

a first gearwheel having a first module, and having teeth arranged to mesh with said rack of said support member;

a second gearwheel having teeth and a second module smaller than said first module, said second gearwheel being secured to said first gearwheel;

a drive pawl operable to engage said second gearwheel so as to advance said rack in a working direction via said first gearwheel; and a retaining pawl operable to engage said second gearwheel so as to prevent said rack from reversing in a direction opposite to the working direction via said first gearwheel;

wherein said drive device is operable to move said rack of said support member progressively in the working direction due to pivoting back-and-forth movement of said actuator trigger connected to said drive device.

2. The tool of claim 1, wherein said teeth of said first gearwheel are uniformly sized and spaced evenly around an entire periphery of said first gearwheel, and said teeth of said second gearwheel are uniformly sized and spaced evenly around an entire periphery of said second gearwheel.

3. The tool of claim 1, wherein said first gearwheel has a smaller quantity of teeth than said second gearwheel.

4. The tool of claim 1, wherein said first gearwheel and said second gearwheel are formed together as a unitary, integrated stepped gearwheel having a one-piece construction.

5. The tool of claim 1, wherein said rack of said support member is mounted so as to be operable to slide relative to said body.

6. The tool of claim 1, wherein each of said drive pawl and said retaining pawl has an engaging contact surface, said drive pawl and said retaining pawl being shaped and arranged such that, during an unlocking movement of said actuator trigger, said engaging contact surface of said drive pawl contacts said engaging contact surface of said retaining pawl so as to disengage said retaining pawl from said second gearwheel to allow said support member with said rack to move in the direction opposite to the working direction.

7. The tool of claim 1, wherein said working head is operable to bend tubes.

8. The tool of claim 7, wherein said working head includes a die and two side stop abutments for supporting a tube during a working process, said side stop abutments being mounted at each end of a supporting crossbar provided on the body.

9. The tool of claim 1, wherein said working head includes:

a crossbar mounted on said body so as to be orthogonal to a longitudinal axis of said body;

a pair of side stop abutments, one of said pair of side stop abutments being located at each end of said crossbar;

a die having a groove therein for receiving a tube, said die being attached to an end of said support member.

10. A tube-working tool comprising:

a body;

an actuator trigger hinged to said body for pivoting relative to said body;

a support member supporting a working head, said support member comprising a toothed rack and being movably connected to said body; and a drive device mounted on said body and connected to said actuator trigger, said drive device being operable to move said support member relative to said body, said drive device including:

a first gearwheel having a first module, and having teeth arranged to mesh with said rack of said support member;

a second gearwheel having teeth and a second module smaller than said first module, said second gearwheel being secured to said first gearwheel;

a drive pawl operable to engage said second gearwheel so as to advance said rack in a working direction via said first gearwheel; and a retaining pawl operable to engage said second gearwheel so as to prevent said rack from reversing in a direction opposite to the working direction via said first gearwheel;

wherein said drive device is operable to move said rack of said support member progressively in the working direction due to pivoting back-and-forth movement of said actuator trigger connected to said drive device; and wherein said rack comprises a toothed sector mounted so as to be pivotable relative to said body.

11. A tube-working tool comprising:

a body;

an actuator trigger hinged to said body for pivoting relative to said body;

a support member supporting a working head, said support member comprising a toothed rack and being movably connected to said body; and a drive device mounted on said body and connected to said actuator trigger, said drive device being operable to move said support member relative to said body, said drive device including:

a first gearwheel having a first module, and having teeth arranged to mesh with said rack of said support member;

a second gearwheel having teeth and a second module smaller than said first module, said second gearwheel being secured to said first gearwheel;

a drive pawl operable to engage said second gearwheel so as to advance said rack in a working direction via said first gearwheel; and a retaining pawl operable to engage said second gearwheel so as to prevent said rack from reversing in a direction opposite to the working direction via said first gearwheel;

wherein said drive device is operable to move said rack of said support member progressively in the working direction due to pivoting back-and-forth movement of said actuator trigger connected to said drive device;

wherein each of said drive pawl and said retaining pawl has an engaging contact surface, said drive pawl and said retaining pawl being shaped and arranged such that, during an unlocking movement of said actuator trigger, said engaging contact surface of said drive pawl contacts said engaging contact surface of said retaining pawl so as to disengage said retaining pawl from said second gearwheel to allow said support member with said rack to move in the direction opposite to the working direction, wherein said drive device further includes a drive pawl spring and a retaining pawl spring, said drive device being arranged such that, when a cam portion of said drive pawl contacts a cam portion of said retaining pawl so as to compress said drive pawl spring and cause a rear end of said drive pawl to abut against a surface of said actuator trigger, said cam portion of said drive pawl presses against said cam portion of said retaining pawl so as to compress said retaining pawl spring and disengage said retaining pawl from said second gearwheel.

12. A tube-working tool comprising:

a body;

an actuator trigger hinged to said body for pivoting relative to said body;

a support member supporting a working head, said support member comprising a toothed rack and being movably connected to said body; and a drive device mounted on said body and connected to said actuator trigger, said drive device being operable to move said support member relative to said body, said drive device including:

a first gearwheel having a first module, and having teeth arranged to mesh with said rack of said support member;

a second gearwheel having teeth and a second module smaller than said first module, said second gearwheel being secured to said first gearwheel;

a drive pawl operable to engage said second gearwheel so as to advance said rack in a working direction via said first gearwheel; and a retaining pawl operable to engage said second gearwheel so as to prevent said rack from reversing in a direction opposite to the working direction via said first gearwheel;

wherein said drive device is operable to move said rack of said support member progressively in the working direction due to pivoting back-and-forth movement of said actuator trigger connected to said drive device;

wherein said drive pawl and said retaining pawl are identical.

* * * * *